US009463370B2

(12) United States Patent
Howell

(10) Patent No.: US 9,463,370 B2
(45) Date of Patent: Oct. 11, 2016

(54) SKI BINDING HEEL UNIT

(71) Applicant: Richard J. Howell, Stowe, VT (US)

(72) Inventor: Richard J. Howell, Stowe, VT (US)

( * ) Notice: Subject to any disclaimer, the term of this patent is extended or adjusted under 35 U.S.C. 154(b) by 0 days.

(21) Appl. No.: 14/349,939

(22) PCT Filed: Mar. 21, 2014

(86) PCT No.: PCT/IB2014/000413
§ 371 (c)(1),
(2) Date: Apr. 4, 2014

(87) PCT Pub. No.: WO2014/147472
PCT Pub. Date: Sep. 25, 2014

(65) Prior Publication Data

US 2015/0375087 A1 Dec. 31, 2015

Related U.S. Application Data

(60) Provisional application No. 61/803,922, filed on Mar. 21, 2013.

(51) Int. Cl.
*A63C 9/08* (2012.01)
*A63C 9/084* (2012.01)
*A63C 9/00* (2012.01)

(52) U.S. Cl.
CPC ..... *A63C 9/0844* (2013.01); *A63C 9/001* (2013.01); *A63C 9/007* (2013.01)

(58) Field of Classification Search
CPC .. A63C 9/0807; A63C 9/082; A63C 9/0845; A63C 9/08; A63C 9/084; A63C 9/0841
See application file for complete search history.

(56) References Cited

U.S. PATENT DOCUMENTS

| | | | | |
|---|---|---|---|---|
| 3,734,522 | A * | 5/1973 | Salomon | A63C 9/08 280/634 |
| 3,992,032 | A * | 11/1976 | Swenson | A63C 9/001 280/632 |
| 4,070,034 | A | 1/1978 | Swenson | |
| 4,134,603 | A | 1/1979 | Zoor | |
| 5,190,312 | A | 3/1993 | Baggio et al. | |
| 5,228,715 | A | 7/1993 | Sedlmair | |
| 2004/0173994 | A1 | 9/2004 | Howell | |

* cited by examiner

*Primary Examiner* — Bryan Evans

(74) *Attorney, Agent, or Firm* — Brouillette and Partners; Robert Brouillette

(57) ABSTRACT

An improved ski binding heel unit comprising a lateral heel release mechanism to release the heel of a ski boot from a ski is disclosed. The ski binding heel unit typically includes an independent vertical heel release mechanism, an independent lateral heel release mechanism, and a longitudinal pressure compensator. The improved ski binding heel unit allows a reduction in the height of the heel pad. This reduction in heel pad height is generally achieved by eccentrically positioning two or more of the springs within the heel unit while superpositioning the resultant centroid of the forces of friction between the lower housing and mating heel track structures that house at least one of the eccentrically positioned springs to foster smooth longitudinal displacement of the lower heel housing when the ski flexes and counterflexes.

4 Claims, 11 Drawing Sheets

SKI BINDING HEEL UNIT

CROSS-REFERENCE TO RELATED APPLICATIONS

The present patent application claims the benefits of priority of commonly assigned U.S. patent application Ser. No. 61/803,922, entitled "SKI BINDING HEEL UNIT" and filed at the United States Patent and Trademark Office on Mar. 21, 2013.

FIELD OF THE INVENTION

The present invention generally relates to alpine ski bindings, all-terrain (AT) ski bindings, tech-bindings and, in particular, to multi-directional release alpine, AT and tech ski binding heel units that release in the vertical and lateral directions.

BACKGROUND OF THE INVENTION

Toe-heel type bindings that provide lateral heel release and which mitigate inadvertent pre-release have been proposed. However, during aggressive edging on hard-pack snow or ice, or especially in the presence of Phantom Foot or Slip-Catch events (for more information about these injury mechanisms, please refer to: Effect of Ski Binding Parameters on Knee Biomechanics; A Three-Dimensional Computational Study, *Med. Sci. Sports Exerc.,* 2004; July; 36(7):1218-25; as well as, Kinematics of Anterior Cruciate Ligament Ruptures in World Cup Alpine Skiing: 2 Case Reports of the Slip-Catch Mechanism, *Am J Sports Med,* 2013 May; 41(5):1067-73; and Critical Load Cases for Knee Ligaments at Skiing—An Engineering Approach, Skiing Trauma and Safety: Thirteenth Volume ASTM STP 1397, 2000:160-74; incorporated herein by reference), those bindings with their correspondingly tall heel pads increase the effective lever arm over which the abduction force component of a Phantom Foot or Slip-Catch event acts, thereby increasing valgus torque within the knee. Excessive valgus torque within the knee causes excessive strain across the anterior cruciate ligament (ACL), excessive strain across the medial collateral ligament (MCL), excessive compressive loads on the lateral surfaces of the proximal tibial plateau, excessive compressive loads on the lateral surfaces of the menisci, and excessive compressive loads on the lateral condyles of the distal end of the femur. As such, the presence of excessive strain and compressive loading has required proposed bindings to release laterally at the heel in order to limit the strain and compressive loads. Those prior art lateral heel release bindings with their tall heel pads also have the capacity to generate large tensile loading of the ACL during Boot Induced Anterior Drawer (BIAD) events, which pure or nearly-pure BIAD-events, lateral heel release bindings cannot address. The inherently tall heel pads of those lateral heel release bindings are a consequence of the stacking-height of the lateral heel release mechanism and the longitudinal pressure spring(s). The heel pads of those lateral heel release bindings have heights of 30 mm and more when measured from the ski top surface to the upper surface of the heel pad, where the boot typically sits.

Tall heel pads extend the distance from the snow surface to the knee, thereby increasing the effective lever arm from the point at which abduction forces enter the medial edge of the ski (under, or near, the projected axis of the tibia) at the ski-snow boundary—to the center of the knee. Increasing the distance over which an abduction force generates valgus torque to the knee—together with the addition of tibia torque—increases strain across the ACL (Valgus Plus Internal Rotation Moments Increase Anterior Cruciate Ligament Strain More Than Either Alone. *Med. Sci. Sports Exerc.,* 2011 August; 43(8):1484-91. incorporated herein by reference). Increased strain across the ACL then increases the possibility that the ACL will reach its elastic limit, causing a skier to sustain a Grade-I ACL sprain (semi-mild sprain), Grade-II ACL sprain (significant sprain); or causing a skier to sustain a Grade-III ACL rupture. ACL injuries are the most frequent injury in alpine skiing (see the peer reviewed journal paper on ski-injury epidemiology, Snowboarding Injuries: Trends Over Time and Comparisons with Alpine Skiing Injuries, *Am J Sports Med*, Jan. 12, 2012; published online as a preview, incorporated herein by reference) and are severe in terms of the level of debility imparted because they require at least 8-months of aggressive rehabilitation after reconstructive surgery. Recently, it was estimated that approximately 50,000 skiing-ACL injuries occurred during the 2011-12 alpine ski season at an estimated US$20,000 cost per injury, or a total accumulated cost of US$1-billion per year. The estimated US$20,000 cost per injury includes diagnosis, treatment and rehabilitation, but does not include the costs associated with the typical onset of early PTOA (post-traumatic osteoarthritis) or the social cost of worker-compensation during the course of rehabilitation. Alpine skiing ACL injuries are therefore both frequent and severe. As such, an alpine ski binding, an AT ski binding and/or a tech ski binding that is able to mitigate such injuries would be highly desirable.

There is thus a need for a ski binding that provides the benefits of lateral heel release and retention while minimizing the forces, torques and bending moments that are transferred to the musculoskeletal structures of the leg (e.g. the knee, the ACL, the MCL, the tibial plateau, the menisci and the condyles of the femur) by the lever arm from the snow surface to the knee. Similarly, the minimization of forces, torques and bending moments acting upon these musculoskeletal structures will result in a reduced number of instances whereupon the lateral heel release of a binding should be actuated.

SUMMARY OF THE INVENTION

The shortcomings of prior art ski bindings with respect to lateral heel release are at least mitigated by an alpine, AT, or tech ski binding that provides additional protection against knee injuries, including injuries to the ACL, MCL, tibial plateau, menisci, and femoral condyles by reducing the length of the lever arm from the snow-surface to the knee. In accordance with the principles of the present invention, additional mitigation of knee injuries is obtained by providing a laterally-releasing heel unit of a ski binding wherein the heel unit has a lowered heel pad.

The lowered heel pad lateral heel release binding will generally reduce peak strain across the ACL and MCL and generally reduce compressive loading on the tibial plateau, the menisci and femoral condyles by reducing valgus torque and valgus bending moments to the knee. Such lowered configuration generally also allows a reduction in cumulative stress to these musculoskeletal structures, and also serves to reduce the frequency in which a lateral heel release binding needs to release the ski boot (or in an equal-magnitude and opposite-direction perspective—release the ski) because both the frequency and the severity of loading is reduced. Consequently, reducing the frequency of lateral heel releases also serves to mitigate second-order-injury effects during release-events. Second-order-injuries include events such as having the released ski hitting the skier (or hitting other skiers) during the time between when the ski releases and when the ski comes to a full stop; or reducing the need for a skier with only one remaining ski to ski to a controlled stop without first striking a tree, lift-tower, other skier, or from impacting the snow surface. Each such release-event and possible subsequent impact could cause an upper-body or head injury that could result in a more severe injury than an injury to the ACL, MCL, tibial plateau, menisci or femoral condyles.

In a lateral heel release ski binding, the height of the heel pad is typically guided by the height of the heel cup of the upper heel housing. Accordingly, in order to reduce the height of the heel pad, the upper heel housing also requires lowering. One way in practice to lower the upper heel housing is to lower the lower heel housing to which the upper heel housing is typically indirectly connected.

In accordance with the principles of the present invention, lowering the heel pad is generally achieved by reducing the "stacking height" of the mechanical elements inside the lower heel housing. Such reduction in stacking height must take into account significant restrictions such as the width limits of narrow skis, whereon a binding heel unit, including the binding heel unit's related ski-brake elements, should not significantly overhang the width of a narrow ski. Furthermore, the lowered lower heel housing should translate, longitudinally, within its mating heel track, as smoothly and as rapidly as possible during rapid flex and counter-flex of the ski, even in the presence of the eccentric lateral loads that cause the lower heel housing to partially-rotate within its corresponding heel track. Partial-rotation should not cause longitudinal jamming in ways similar to the jamming of dresser-drawers. For example, during the induction of an ACL-straining abduction force generated under or near the projected axis of the tibia, the abduction force can sometimes enter the ski-binding-boot-leg system aftward of the effective lateral-centroid of the lower heel housing and heel track assembly thereby potentially causing a jamming-effect unless a novel heel track system is deployed to avert such jamming effect.

In accordance with the principles of the present invention, the lowering of the heel pad is generally achieved by reducing the "stacking height" of the mechanical elements inside the lower heel housing. Such reduction in stacking height is typically achieved through a reorganisation of the mechanical elements, such as the springs. The reorganisation of the springs will generally result in having the longitudinal pressure spring positioned eccentrically. For instance, one way to reduce the stacking height referred to herein would be to have the lateral heel release spring(s) and the longitudinal pressure spring(s) in a side by side configuration. However, such side by side configuration could potentially lead to a lower heel housing having springs disposed too asymmetrically to one another. Typically, the reorganisation of the mechanical elements that lower the height of the top surface of the heel pad will result in the lower heel housing being secured, slidingly-longitudinally within the heel track through surfaces of the heel track that are not adjacent to the counter-resistive forces of the longitudinal pressure mechanism, thereby inducing too much friction between the lower heel housing and mating heel track, potentially impeding proper movement of the lower heel housing within the mating heel track during rapid flex and counter-flex of the ski.

In accordance with the principles of the present invention, the configuration of the interface between the lower heel housing and heel track assembly maximizes the balance of the opposing forces of the eccentrically positioned longitudinal pressure spring against the resultant-refracted force of friction formed at the interfaces between the lower heel housing and heel track—in order to promote smooth longitudinal displacement between the lower heel housing and heel track.

Other and further aspects and advantages of the present invention will be understood by review of the illustrative embodiments about to be described and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which:

FIG. 13 is a rear view diagram of the heel unit of FIG. 2.

DETAILED DESCRIPTION OF THE PREFERRED EMBODIMENT

A novel alpine, AT or 'tech' ski binding heel unit will be described hereinafter. Although the invention is described in terms of specific illustrative embodiments, it is to be understood that the embodiments described herein are by way of example only and that the scope of the invention is not intended to be limited thereby.

Figure 1:
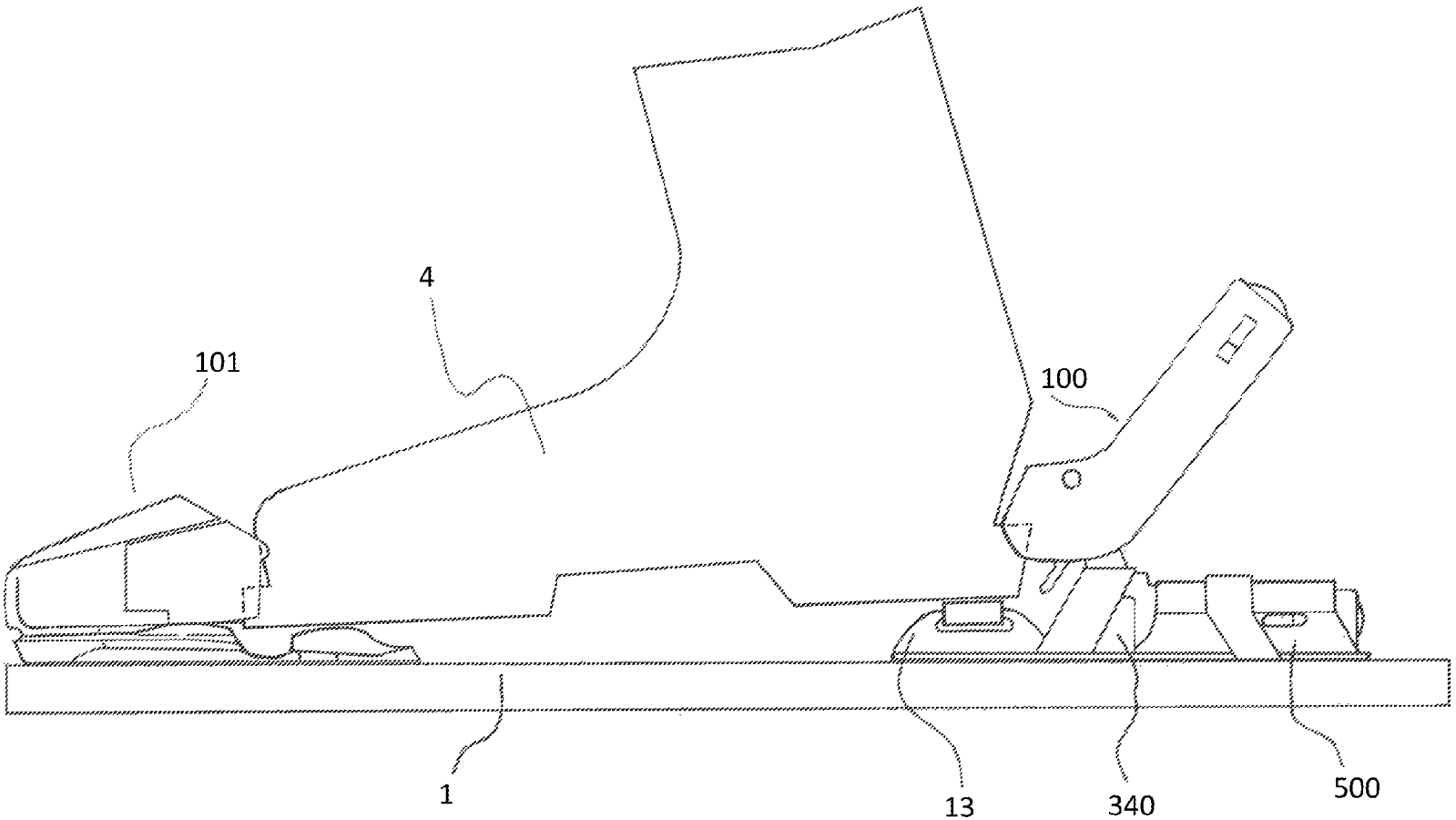
FIG. 1 is a left side view of a lateral heel release alpine ski binding in accordance with the principles of the present invention.
Figure 7:
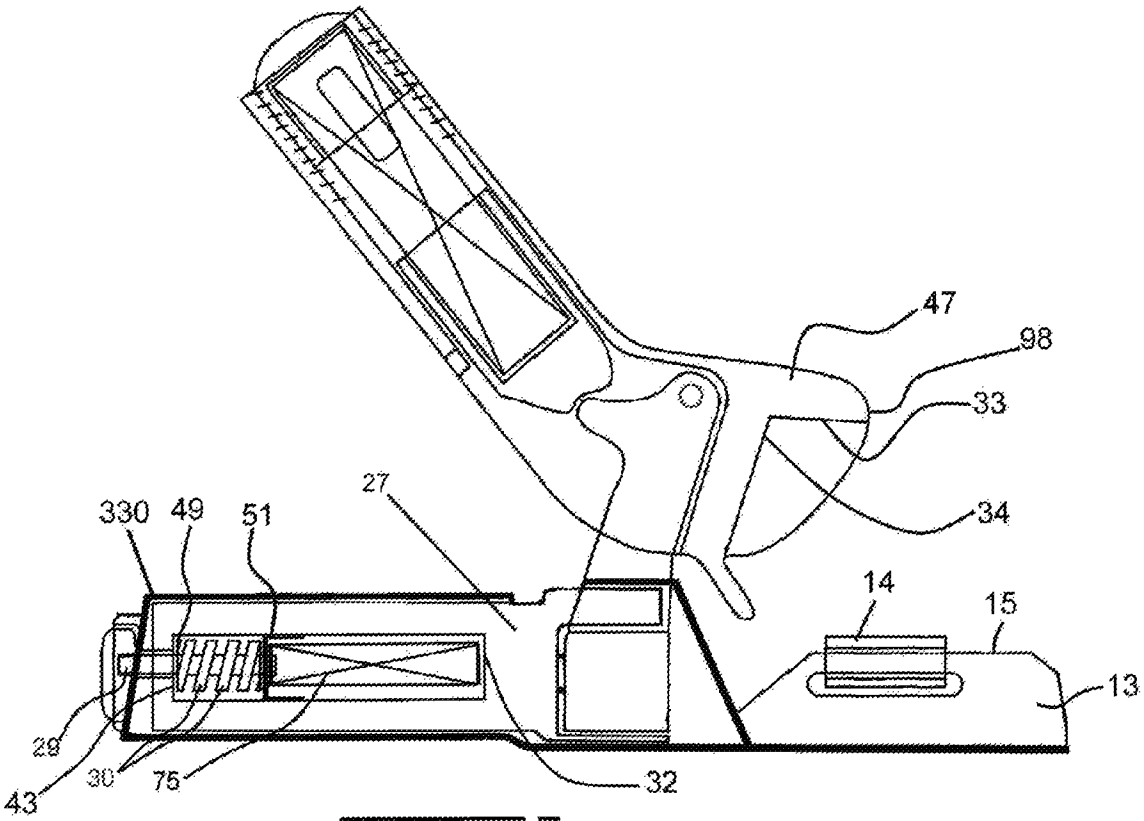
FIG. 7 is a cross-sectional right side view of the heel unit of FIG. 2.
Figure 9:
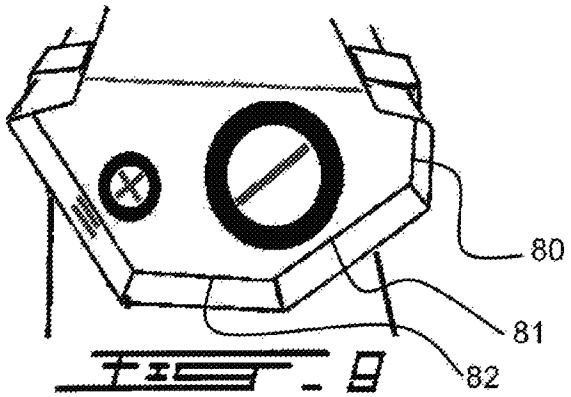
FIG. 9 is a top rear perspective view of another embodiment of an alpine ski binding heel unit in accordance with the principles of the present invention.
Figure 11:
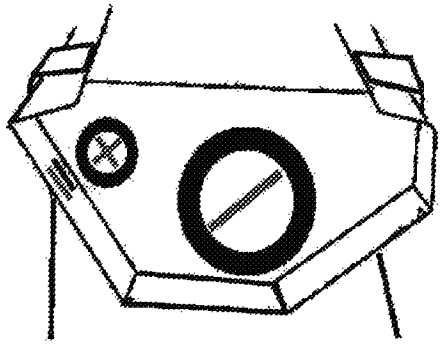
FIG. 11 is a top rear perspective view of another embodiment of an alpine ski binding heel unit in accordance with the principles of the present invention.
Figure 8:
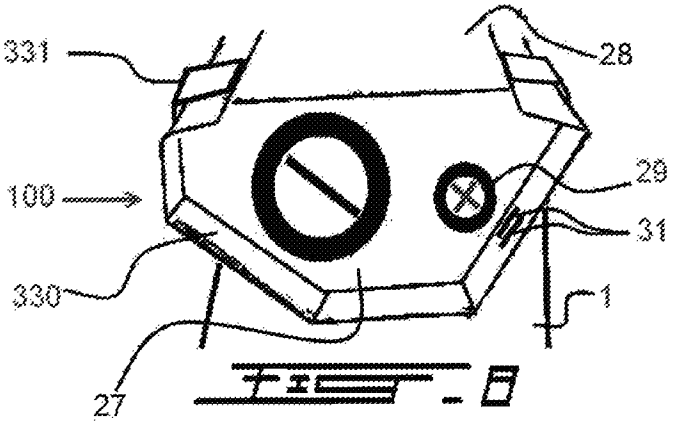
FIG. 8 is a top rear perspective view of the heel unit of FIG. 2.

Now referring to FIG. 1, a ski binding comprising a toe unit 101 and a heel unit 100 is shown. In accordance with the present invention, the top surface of heel pad 13 has been lowered as a result of the lowered support structure 500 that houses the lateral heel release mechanism 340 (FIG. 2) and longitudinal pressure spring 75 (FIG. 7).

Figure 2:
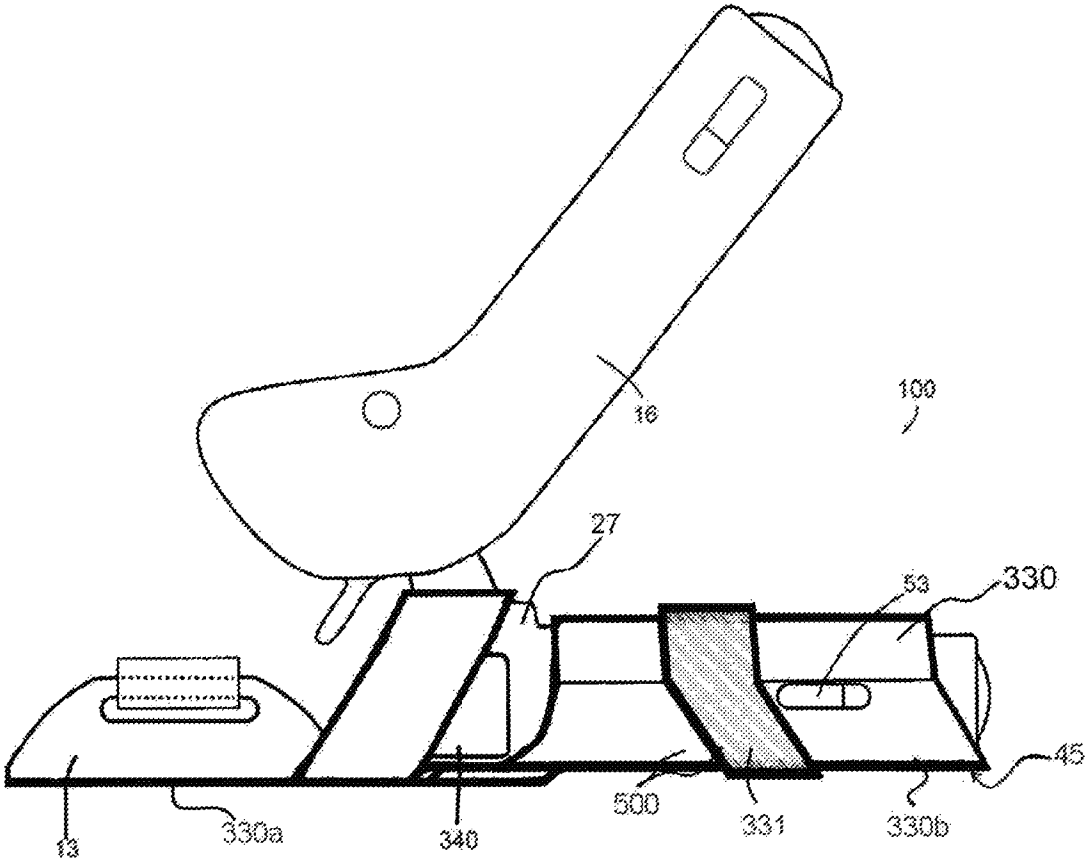
FIG. 2 is a left side view of the heel unit of the ski binding of FIG. 1.
Figure 3:
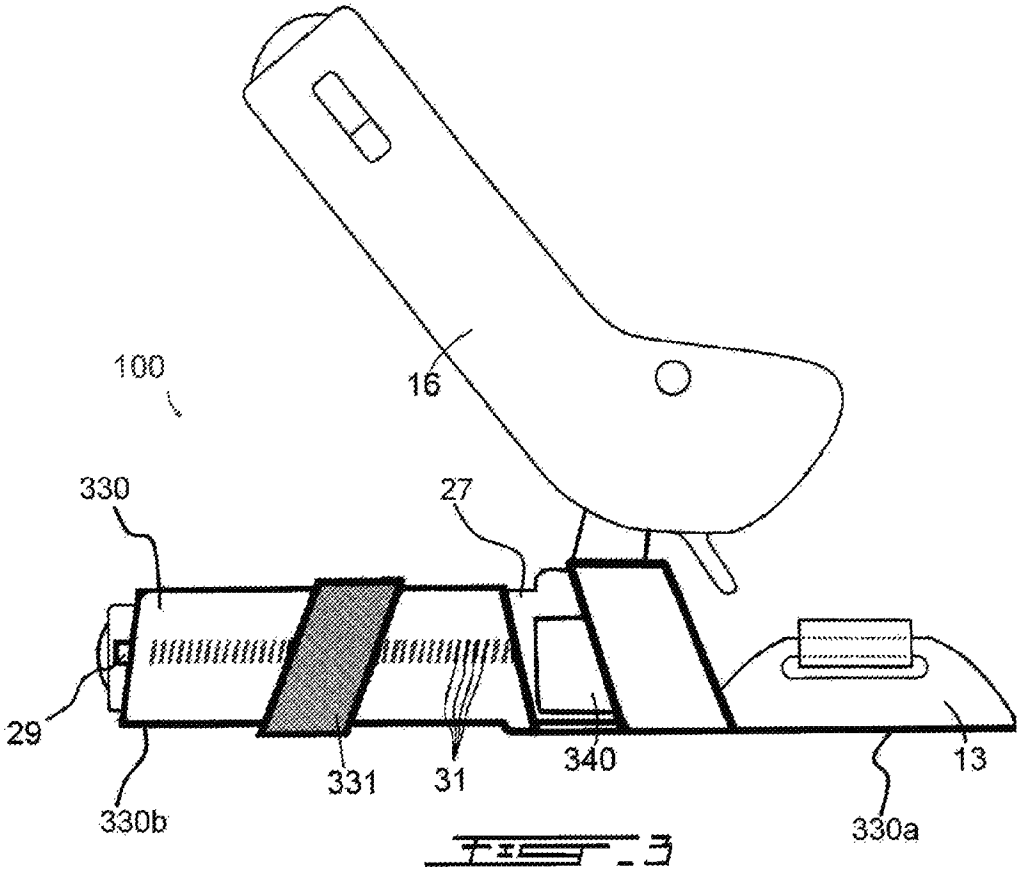
FIG. 3 is a right side view of the heel unit of FIG. 2.

Now referring to FIGS. 2 and 3, the heel unit 100 comprises an upper heel housing 16, a lower heel housing 27, a heel pad 13, and a heel track 330. The lower heel housing 27 contains at least one lateral release mechanism 340. The heel pad 13 is connected or fixed to the heel track 330. The heel track 330 comprises a front portion 330*a* and a rear portion 330*b*. In the present embodiment, the heel track front portion 330*a* is preferably anchored to the ski by fasteners (not shown). A rear heel prong guide 331 is typically also anchored to the ski structure (not shown), preferably underneath the rear portion 330*b* of the heel track 330. As such, the rear heel prong guide 331 provides support to the rear portion 330*b* of the heel track 330 independently of the change in strain that takes place between the fasteners of the heel track's front portion 330*a* and the fasteners of the rear heel prong guide 331 during bending of the ski—though 330 and 330*b* as well as 330*a* could be attached directly into an under-binding device, an AT-rail, a rail-system, an integral-binding-ski-system or directly to the ski without 331.

In other embodiments, the heel track 330 and/or rear heel prong guide 331 and/or heel track 330 could be moulded into the ski structure. In still other embodiments, the heel track 330 and/or rear heel prong guide 331 and/or heel track 330 could also be fixedly-integrated into the ski. In the latter embodiments, although part of the binding would be integrated within the ski structure, the user would preferably have the ability to remove the integrated part(s) if necessary.

Figure 4:
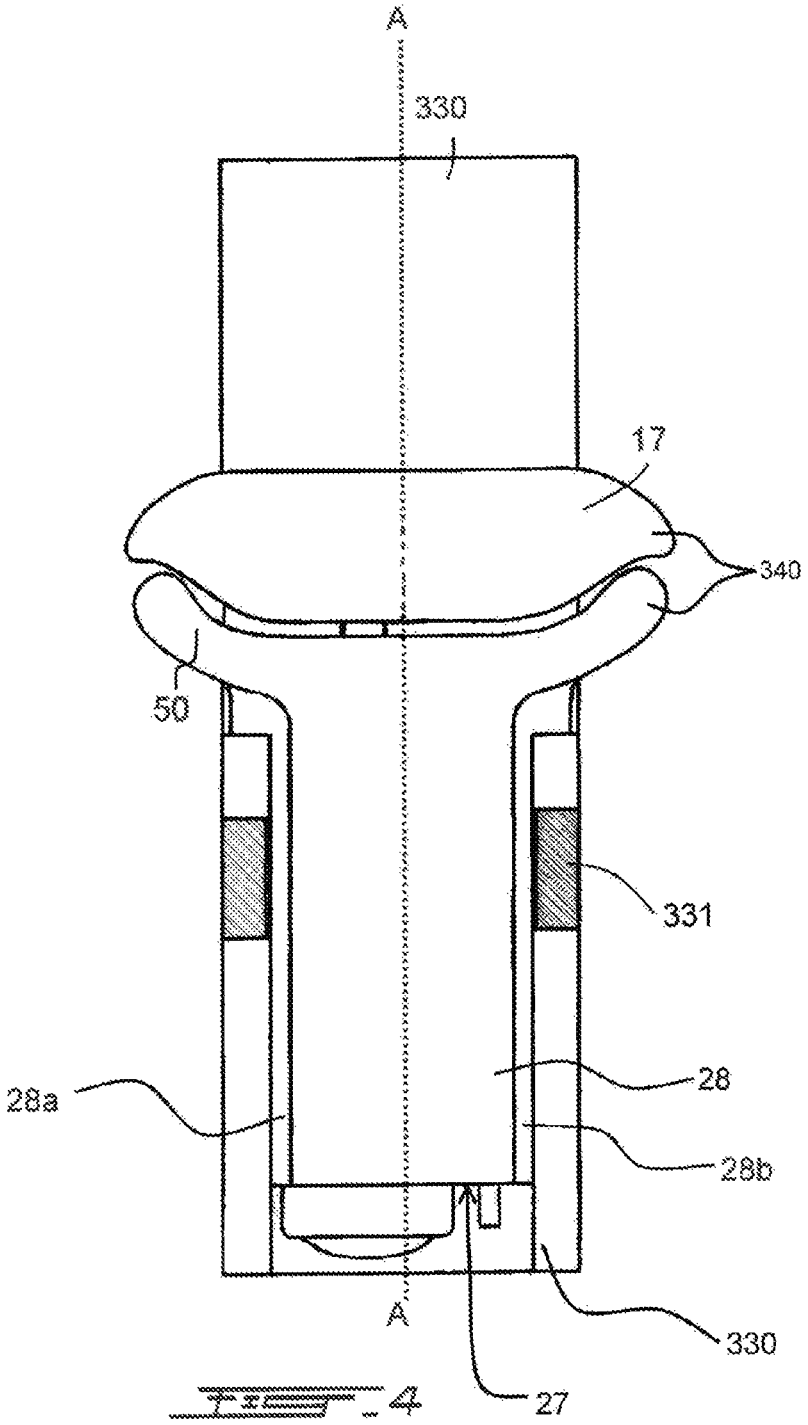
FIG. 4 is a cross-sectional top view of the heel unit of FIG. 2.
Figure 5:
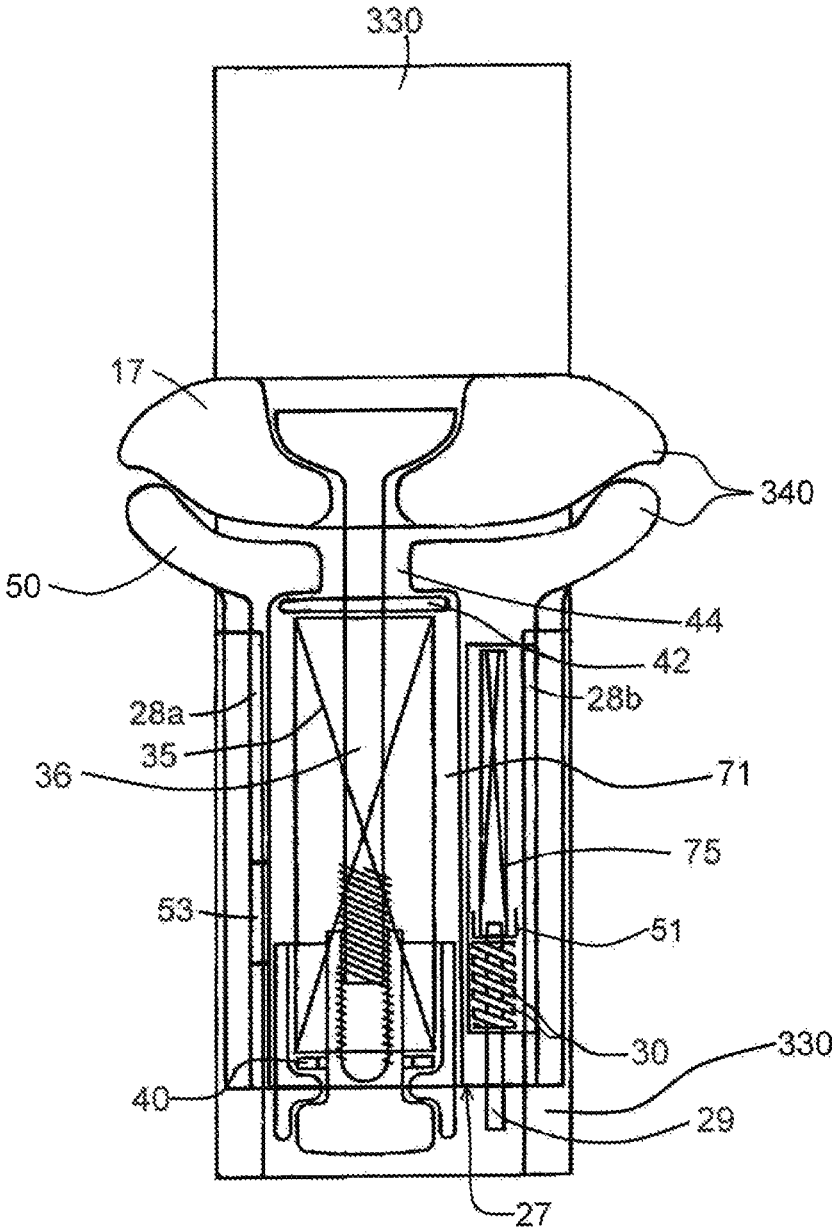
FIG. 5 is a detailed cross-sectional top view of the heel unit of FIG. 2.

Now referring to FIGS. 4-5, the lateral release cam 17 is disposed next to mating cam 50 as taught by Bogner et al. in U.S. Pat. No. 5,205,576. Typically, the lateral release mechanism 340 comprises the lateral release cam 17, the mating cam 50, at least one lateral heel release spring 35, at least one tension shaft member 36, optional washers 40 and 42, and at least one optional lateral release indicator 53 and an integral opening 44. In the present embodiment, the heel track 330 comprises a bottom surface 45 (FIG. 2) and slots 31 (FIG. 3). The front portion of bottom surface 45 is typically connected to the top surface of a ski (not shown), to a riser plate (not shown), a lifter (not shown) or to an integral rail-system (not shown).

Still referring to FIG. 4, the release binding assembly 100 for securing the heel portion of a ski boot to a ski having a top surface, the release binding assembly generally comprises a lower heel assembly comprising a heel track 330 typically attachable to the top surface of the ski, a lower heel housing 27 having two laterally disposed portions and a central longitudinal axis (A-A), a surface having at least a pair of cams 50 disposed on either side of said central longitudinal axis (A-A), wherein the heel track 330 is configured to slidingly engage the lower heel housing 27, wherein the portions of the lower heel housing 27 typically engaging the heel track 330 are asymmetric relative to said central longitudinal axis (A-A), an upper heel assembly 47 coupled to the lower assembly, and a lateral release assembly for applying lateral securing pressure to the ski boot, the lateral release assembly comprising a surface having at least a second pair of cams 17, complementary to and facing the first pair of cams 50, disposed on either side of said central longitudinal axis (A-A). In the present embodiment, the lower heel assembly comprises at least one laterally off-center longitudinal pressure spring 75 relative to said central longitudinal axis (A-A). In addition, the lower heel housing 27 is generally secured to at least one side wall of the heel track 330. As such, the heel track is generally substantially asymmetric and matches the lower heel housing 27.

The lower heel housing 27 generally slides longitudinally within heel track 330, which sliding is typically controlled by the compressive force of the longitudinal pressure spring 75 against the lower heel housing 27. The lower heel housing is generally limited in maximum aftward longitudinal travel by the coil-to-coil compression of spring 75 and also typically limited in forward longitudinal travel by the shoulder 49 of worm gear 29 acting against lower heel housing 27 on wall 43 (FIG. 7). In addition, lower heel housing 27 is generally attached to and positioned on heel track 330 by the selective engagement of teeth 30 of worm gear 29 into slots 31 (FIG. 3) of the heel track 330. Turning worm gear 29 changes the position of the lower heel housing 27 in relation to heel track 330. The ratchet plate 51 serves to semi-fix the rotation of worm gear 29 during incremental rotation of worm gear 29.

Figure 6:
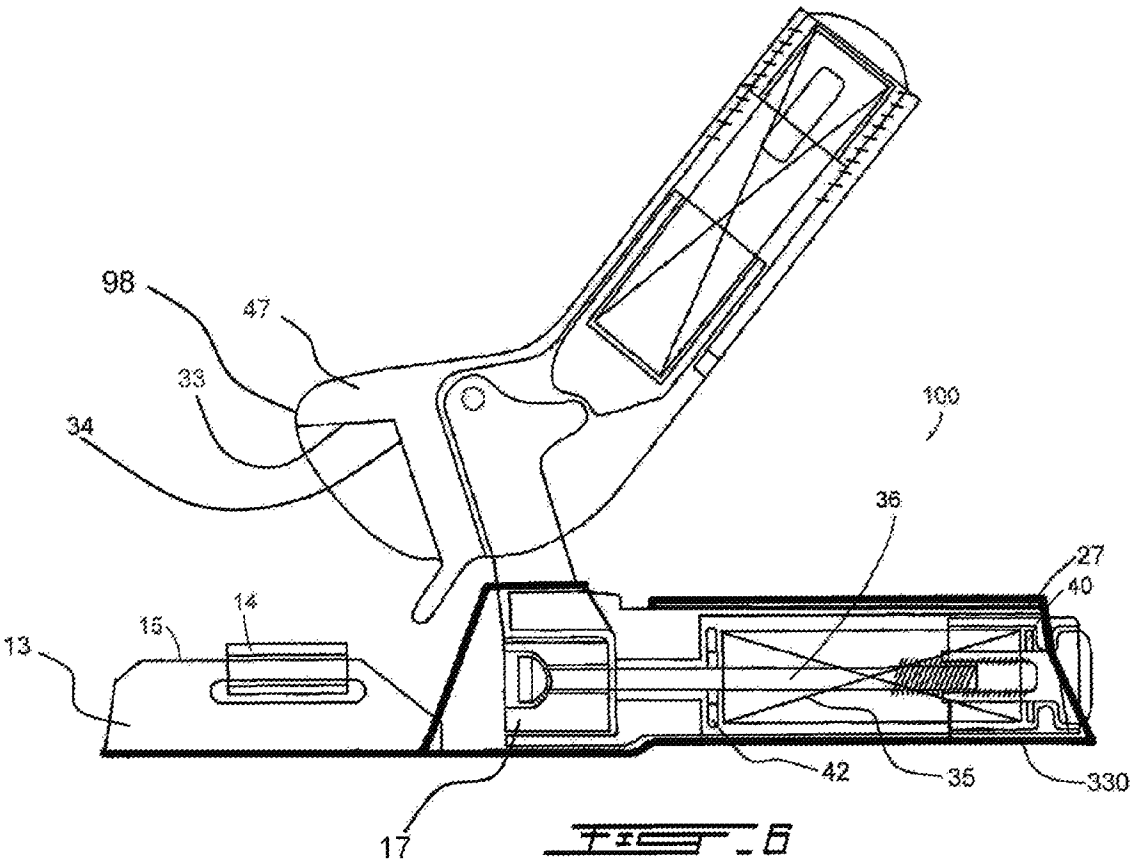
FIG. 6 is a cross-sectional left side view of the heel unit of FIG. 2.

Now referring to FIGS. 6 and 7, a spring biased force is supplied between lower heel housing 27 and heel track 330 by the compression of longitudinal pressure spring 75 on one end of the spring at worm gear 29, which worm gear 29 is selectively positioned and fixed against heel track 330, while the other end of longitudinal pressure spring 75 is compressed by the recessed cavity 32 within lower heel housing 27 when the ski flexes. The longitudinal pressure spring 75 provides longitudinal pressure to the ski boot that is held between the upper heel housing 47 and the alpine binding toe piece 101 to ensure proper fixation of the boot during flex and counter-flex of the ski. When the ski flexes in the presence of an incompressible ski boot sole, the change in strain along the top surface of the ski located between the binding's heel cup and toe cup becomes relieved by the longitudinal translation of the lower heel housing 27 relative to the heel track 330. The heel unit, through the spring-bias action of the longitudinal pressure mechanism, supplies a longitudinal contact force through the incompressible ski boot sole to the toe piece 101 of the binding when the ski flexes. This longitudinal force is proportional to the spring constant of the at least one longitudinal spring 75 and the amount of its compressive displacement. Surface 34 or surface 98 of the heel cup 47 maintain the longitudinal position of the heel unit 100 on the heel projection of the ski boot sole or, respectively, on the upper of the boot (not shown) as a consequence of the longitudinal pressure exerted by the lower heel housing 27. Typically, a shoulder element 49 of worm gear 29 captures worm gear 29 within the aftmost end of the longitudinal pressure cavity of lower heel housing 27. As the longitudinal pressure typically increases during ski flex, the longitudinal pressure spring biasing means, comprising the elements 75, 32, 29, 30, 31 and 51 located within the lower heel housing 27, adapt accordingly.

Prior to the boot being placed between toe piece 101 (FIG. 1) and heel unit 100, the lower heel housing 27 is selectively positioned relative to the heel track 330 by turning worm gear 29 such that the distance between toe piece 101 and heel unit 100 is typically a few millimeters less than the boot sole length. Such shorter distance than the boot sole length is chosen so that during counter-flex of the ski, whereby the change in strain along the top surface of the ski where the toe piece and heel unit are attached, the relative longitudinal position of the toe piece 101 and the heel unit 100 is expanded and thus the lower heel housing 27 displaces forward typically a few millimeters on heel track 330 to maintain contact with the non-expanding boot sole.

The increased compression then decreased compression of the longitudinal pressure mechanism of heel unit 100 can take place among typical ski-boot-binding systems. Therefore, in order for the toe piece and heel piece of the binding to provide and maintain proper contact of surface 33 with the boot sole during the dynamic rhythm of fore-and-aft longitudinal displacement action of the lower heel housing 27 within the heel track 330, the compressive force supplied by the longitudinal pressure mechanism must not be significantly impeded, dissipated or absorbed by the force of friction arising between the mating surfaces of lower heel housing 27 and heel track 330. Such force of friction generally acts cyclically-opposite in direction to the cyclical force supplied by the longitudinal pressure mechanism. Further, the adverse effects of friction have the potential of becoming amplified by the leverage supplied by any distance over which the force of friction is eccentric to the counter-resistive force supplied by the longitudinal pressure mechanism, unless the leverage-effect is minimized.

Figure 10:
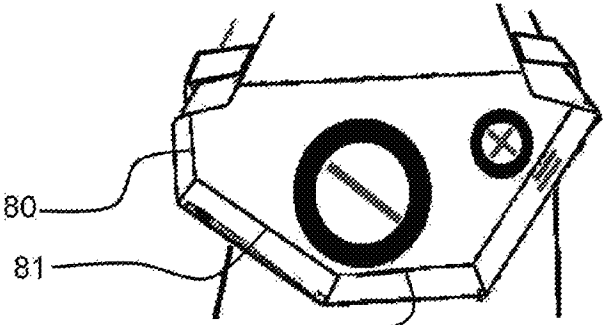
FIG. 10 is a top rear perspective view of another embodiment of an alpine ski binding heel unit in accordance with the principles of the present invention.

The outermost surfaces of upper surface 28 (FIG. 4) comprise the lateral-most surfaces 28*a* and 28*b* of the top sides of lower heel housing 27 together with surfaces 80, 81, 82 (FIG. 10) and 83 (FIG. 12) are uniquely configured to integrate with the cross-sectional orientation of heel track 330, generally to refract the respective forces of friction that would otherwise become adverse to the compressive force supplied by longitudinal pressure spring 75.

Alternatively, heel track 330 could be partially-connected, or fully-connected (not shown) across the top of lower heel housing 27, touching on surfaces 28*b* or 28*a* and/or touching on top surface 28.

Figure 12:
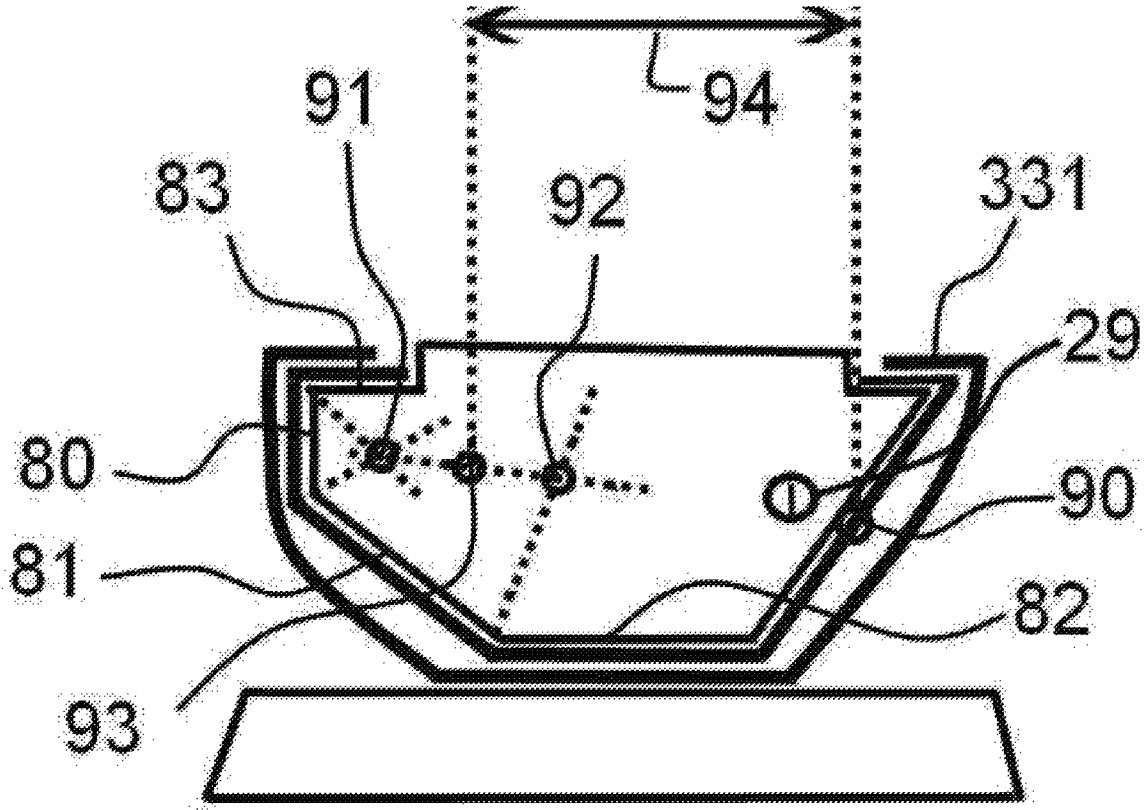
FIG. 12 is a rear view force diagram of the heel unit of FIG. 2.
Figure 17:
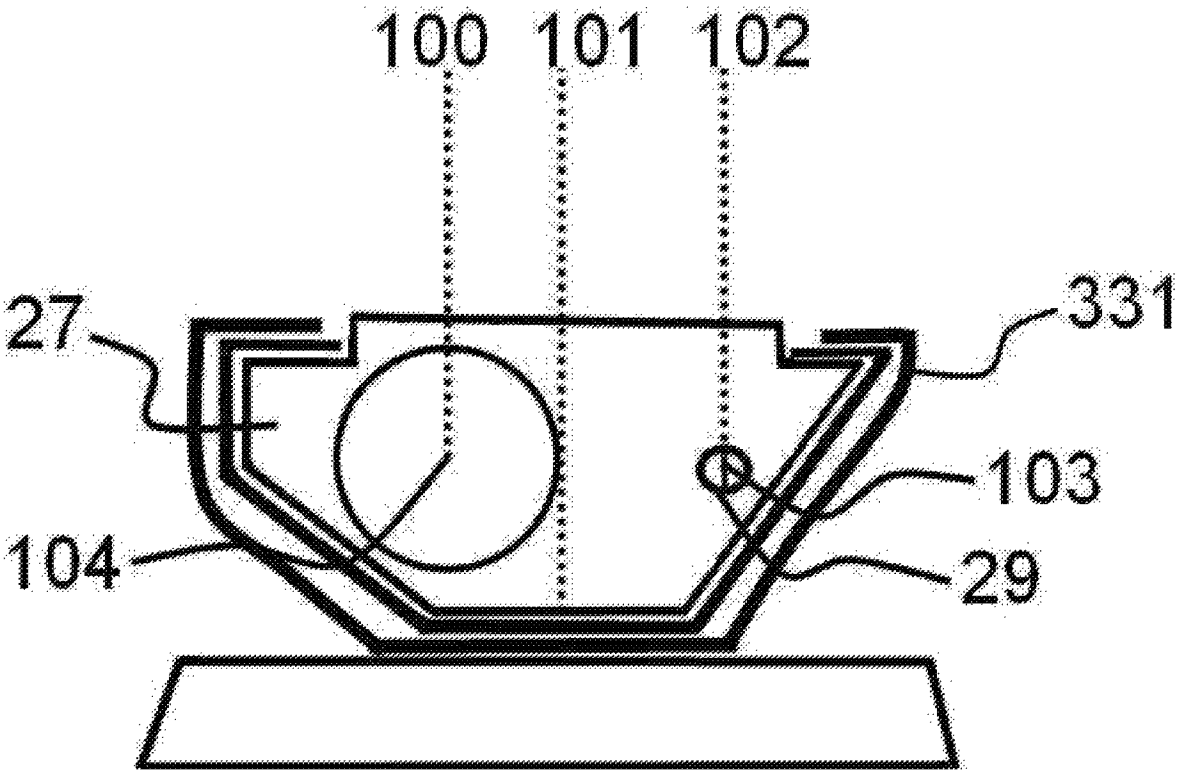

Referring again to FIGS. 6-12, another non-centered spring may be contained within lower heel housing 27. The other non-centered spring may be embodied as a lateral heel release spring 35 and respectively be contained within a non-centered opening 71 within lower heel housing 27. As such, the combination of the non-centered lateral heel release spring and the non-centered forward pressure mechanism allow the height of the lower heel housing 27 and of the corresponding heel track 330 to be reduced to allow the upper heel housing to become respectively lowered, thereby lowering heel cup surface 33 so that the top surface 15, together with optional element 14, of heel pad 13 can become lowered relative to the prior art to mitigate valgus torque through the knee. These means and functions are new and useful over prior art lateral heel release bindings. For clarity purposes, FIG. 12 depicts one example of a force vector centroid and an example of a superpositioned centroid.

Still referring to FIGS. 8-12, the surfaces that are preferably off-center, eccentric to the longitudinal pressure mechanism, and which form the interface between the lower heel housing 27 and heel track 330 are resistive "force-of-friction surfaces" that generate corresponding instant forces of friction that act to oppose the force of the longitudinal pressure spring. Such instant forces of friction at each surface that are eccentric to the longitudinal pressure mechanism can have the perpendicular bisectors of their force-vectors 91 and 92 refracted within the lower heel housing 27 in order to place the virtual loci of their vectors—their superpositioned resultant 93—closer to and less eccentric from the counter-force 90 supplied by the longitudinal pressure spring in order to mitigate the amplification of the leverage 94 that acts between the opposing forces—the force of the longitudinal pressure spring and resultant force of friction. Thus, at least two "force of friction surfaces" at the interface between lower heel housing 27 and heel track 330 supply a "refracted resultant vector force" with a virtual centroid 93 that acts closer to the opposing force 90 supplied by the longitudinal pressure mechanism to mitigate the leverage 94 between the opposing forces in order to maximize the force supplied by the longitudinal pressure mechanism to maintain proper contact of the toe piece 101 and the heel unit 100 on the boot sole.

Such refractive effects comprise generally positioned geometry of the interfacing surfaces of the lower heel housing 27 and heel track 330 to take into account the need to superposition the virtual vector centroid of the overturning moment generated by the 'force of friction surfaces' in order to minimize the jamming effect of the overturning moment and to thus maximize the force supplied by the longitudinal pressure mechanism to maintain contact of the toe piece and heel unit with the boot sole during flex and counter-flex of the ski.

Preferably, the novel geometry of the opposing surfaces that refract a virtual vector centroid, 93, of the overturning moment, comprise a series of flat surfaces 80, 81, 82, 83, that can be non-co-planar to each other; alternatively, a curved surface (not shown); or a series of curved surfaces (not shown); a series of flat and curved surfaces (not shown) or any combination thereof, any of which surfaces generating a confluent locus-point that shifts the virtual centroid of the resultant vector closer to the longitudinal pressure spring in order to minimize the effective lever-arm of the overturning moment that arises between the opposing forces of friction and the longitudinal pressure spring.

Now again referring to FIGS. 8-12, in the embodiment wherein the longitudinal pressure spring (or longitudinal springs) is eccentrically positioned, the lateral heel release alpine, AT, or tech, ski binding heel unit 100 provides a ski binding having a lower heel pad 13 (FIG. 7). This new lateral heel release binding with its lower heel housing 27 and heel track 330 comprise unique surfaces that refract forces of friction and transpose vectors in a way that allows the use of a longitudinal pressure spring 75 that supplies minimally-friction-dissipated, longitudinal pressure forces to the boot that act between the toe piece and heel unit during flex and counter-flex of the ski.

Now referring to FIG. 13, the center 103 of the worm gear 29 and its mating longitudinal pressure spring 75 is off-center of the vertical-center axis 101 of the lower heel housing 27. Likewise, the center 104 of the lateral heel release spring 35 is off-center of the vertical-center axis 101 of the lower heel housing 27.

Figure 14:
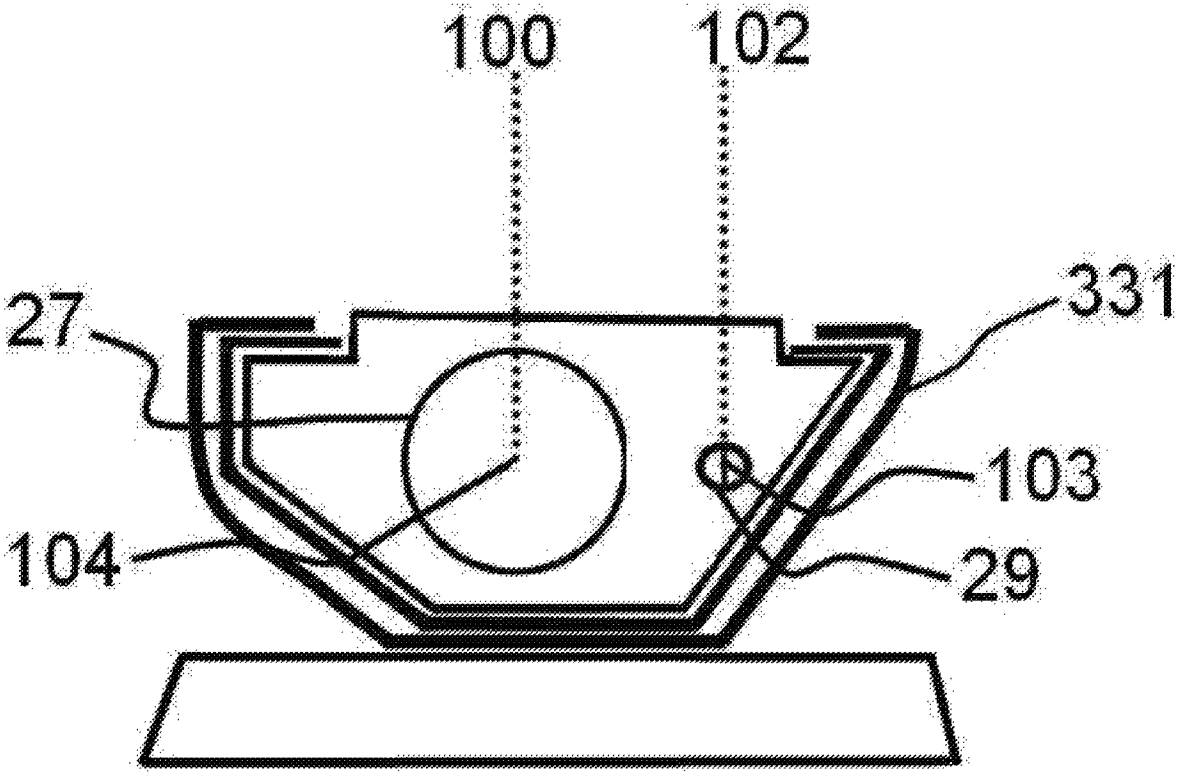
FIG. 14 is a rear view of another embodiment of an alpine ski binding heel unit in accordance with the principles of the present invention.

In another embodiment, now referring to FIG. 14, the center 103 of the worm gear 29 and its mating longitudinal pressure spring 75 is off-center of the vertical-center axis 100 of the lateral heel release spring 35. Such disposition of the springs also allows the stacking height to become favorably reduced. Preferably, the off-center orientation should provide the possibility of refracting the forces of friction in a way that allows their superpositioned centroid to off-set the eccentric effects of friction stemming from the off-center worm gear and its mating longitudinal pressure spring 75, so that smooth longitudinal translation is maximized between the heel track and the lower heel housing.

In still another embodiment, the two springs, the longitudinal pressure spring 75 and the lateral heel release spring 35, could be configured to be located concentrically, one inside the other. Such configuration would also enable the heel pad 13 top surface 15, and/or its optional element 14, to be lowered while still providing longitudinal pressure compensation, smooth longitudinal movement between a lower heel housing 27 and a heel track 330, and a lateral heel release mechanism 340.

The heel pad 13 can be made of plastic or metal. The top surface 15 of heel pad 13 can be of low coefficient of friction plastic, PTFE, a PTFE-phosphorus-nickel compound (such as NIFLOR) plated into top-surface 15. The optional means 14 can be made of rubber or a rubber-like material (such as low flex-modules Nylon-12). The heel track 330 can be made of stamped metal (stainless steel, cold rolled steel, aluminum or the like), and be optionally plated or be of plastic (such as Nylon-12). The lower heel housing 27 and cam 17 can be made of plastic such as, for example, injection molded, non-hydroscopic, Nylon-12, or the like.

While the illustrative and presently preferred embodiment of the invention is described in detail hereinabove, it is to be understood that the inventive means and function may be otherwise variously embodied and employed and that the claims are intended to be construed to include such variations except insofar as limited by the prior art.

The invention claimed is:

1. A release binding assembly for securing the heel portion of a ski boot to a ski, the release binding assembly comprising:

a) a heel pad having a top surface for supporting the ski boot;

b) a lower heel assembly adapted to be attached to the ski adjacent to said heel pad, the lower heel assembly comprising:

c) a heel track; and d) a lower heel housing having a central longitudinal axis adapted to slidingly engage with said heel track and comprising at least one laterally off-centered spring bias relative to said central longitudinal axis, the laterally off-centered spring bias being applied by a longitudinal pressure spring;

e) an upper heel assembly coupled with the lower heel assembly;

wherein the lower heel housing and heel track comprise surfaces that asymmetrically refract forces of friction and asymmetrically transpose vectors in a way that reduces the leverage arising from the off-centered longitudinal pressure spring to supply minimally-friction-dissipated longitudinal pressure forces to the boot that act between a toe piece and the heel unit during flex and counter-flex of the ski.

2. A release binding assembly as claimed in claim 1, wherein two or more of the springs are eccentrically positioned within the heel unit while superpositioning the resultant centroid of the forces of friction between the lower heel housing and heel track structures that house at least one of the eccentrically positioned springs to foster smooth longitudinal displacement of the lower heel housing when the ski flexes and counterflexes.

3. A release binding assembly claimed in claim 1, wherein the release binding is a lateral heel release binding.

4. A release binding assembly as claimed in claim 1, wherein the off-centered longitudinal pressure spring allows the top surface of the heel pad to have a height of smaller or equal to 29 mm relative to the ski top surface.

* * * * *